United States Patent [19]

Cecce

[11] 4,171,053

[45] Oct. 16, 1979

[54] ANTIPENDULATION CRANE

[76] Inventor: Robert F. Cecce, Rte. 1, Box 177E5, Kearneysville, W. Va. 25430

[21] Appl. No.: 827,327

[22] Filed: Aug. 24, 1977

[51] Int. Cl.[2] ..... B66C 23/08

[52] U.S. Cl. ..... 212/58 A; 414/139

[58] Field of Search ..... 212/1, 8 A, 11, 14, 212/40, 41, 58 R, 58 A, 59 R, 97, 125, 133; 214/15 R, 86 R, 657

[56] References Cited

U.S. PATENT DOCUMENTS

| | | | |
|---|---|---|---|
| 1,481,234 | 1/1924 | Smith | 214/86 R X |
| 2,792,130 | 5/1957 | Fetchko | 214/15 R |
| 2,805,781 | 9/1957 | Senn | 212/58 A |

*Primary Examiner*—Robert G. Sheridan
*Attorney, Agent, or Firm*—Michael W. York

[57] ABSTRACT

Antipendulation cranes and apparatus for overcoming the undesirable effects of cargo pendulation are set forth along with variations of such cranes for transferring cargo under more desirable conditions. The cranes include the normal booms and associated apparatus including the normal hoist lines extending in a substantially vertical direction from the end portion of the booms. At the lower end portion of the hoist lines a hook member or other cargo engaging apparatus is provided for the purpose of lifting and lowering cargo. Located between the end portion of the boom of the antipendulation cranes and lower end of the portion of the hoist lines is an apparatus that permits the major portion of the boom hoist lines to remain in substantially a vertical plane to prevent pendulation of the cargo. Other crane apparatus and methods related to the cranes are also presented.

13 Claims, 15 Drawing Figures

62a
15
75
12
53
51
52
88
62
86
62b
74
61
78
80
82
77
85b
81
76
83
85a
79
68
13
84
85c
85a

ANTIPENDULATION CRANE

BACKGROUND OF THE INVENTION

The transfer of the cargo to or from one moving platform or craft such as a large ship or the like has always been difficult especially under adverse water conditions where there may be large waves. The transfer of cargo and the like is made even more difficult when such transfer is made from one watercraft to another watercraft. Although such transfers are inherently difficult they are of necessity carried out, even under severely adverse weather and water conditions when it is necessary.

Such transfers are commonly carried out through the use of cranes that have a boom with a line or lines extending from the end of the boom. Although cranes and in particular their booms appear to be structures that possess inherent strength, the booms are not designed to withstand undue side loadings or forces since they are primarily designed to lift certain loads in substantially a vertical plane. Consequently, excessive side loading caused by pendulation can result in structural failure of the boom with obvious serious effects.

Even if the boom of the crane should be capable of being subjected to the loads resulting from pendulation, the cargo can be easily damaged by impact and in addition such pendulation can cause damage to the transfer or transferring unit and/or the personnel or cargo located on the same. In addition, cargo pendulation problems can result in serious cargo transfer delays which can result in serious detrimental results particularly where the rapid transfer of cargo is essential such as would be the case in certain military or naval operations. Indeed, certain weather or sea conditions could absolutely prevent or seriously curtail certain cargo transfer operations to such an extent that the military or naval operation would fail or be seriously hampered as a result of these adverse conditions.

It is also desirable under certain conditions where pendulation is or is not a dominant factor not to have to raise or lower the boom during the operation of the cranes as is the case in connection with the current cranes.

The crane apparatus of this invention overcomes the previously noted deficiencies and provides apparatus that essentially permit the transfer of cargo without regard to the sea or weather conditions insofar as transfer of cargo between water vessels is concerned. Of course, the same is true with respect to any water to land or land to water transfer. In addition, the apparatus of the invention provide additional advantages in other related conventional operations.

BRIEF DESCRIPTION OF THE INVENTION

This invention relates to crane apparatus and more particularly to cranes that reduce cargo pendulations.

It is an object of the present invention to provide crane apparatus that eliminates or greatly reduces pendulation of the cargo or the means that is connectable to the cargo.

It is also an object of the present invention to provide crane apparatus that prevents or greatly eliminates potential damage to the cargo that is being transferred by the crane apparatus.

It is also an object of the present invention to provide cargo apparatus that permits efficient transfer of cargo to or from a moving vessel.

It is also an object of the present invention to provide crane apparatus that can be utilized to efficiently transfer cargo from one vessel to another even though one of the vessels may be in vertical motion.

It is also an object of the present invention to provide crane apparatus that prevents or greatly eliminates potential damage to the cargo receiving vessel.

It is also an object of the present invention to provide crane apparatus that prevents or eliminates possible damage to the transferring vessel.

It is also an object of the present invention to provide crane apparatus that permits the transferring of cargo without the need to raise or lower the cargo boom when the cargo is moved inwardly or outwardly during cargo transferring operations.

It is also an object of the present invention to provide crane apparatus that reduces or eliminates possible damage to the crane apparatus due to loads caused by pendulation.

It is also an object of the present invention to provide apparatus to convert current conventional crane apparatus to obtain the benefits associated with reduced or eliminated cargo pendulation.

It is also an object of the present invention to provide apparatus to convert conventional crane apparatus or permit it to be converted to prevent or reduce undesirable cargo pendulation problems.

It is also an object of the present invention to provide apparatus to convert conventional crane apparatus to permit it to be converted so that certain crane operations are possible without the need to raise or lower the cargo boom in the usual manner.

The present invention provides crane apparatus having a boom with inner, outer and side portions, a boom hoist member and topping members including a hoist member control assembly in movable contact with said hoist member, at least one elongated member extending from the hoist member control assembly and means extending in a direction away from the side of the boom for receiving a portion of the elongated member which extends from said hoist member control assembly.

BRIEF DESCRIPTION OF THE DRAWINGS

The invention will be hereinafter more fully described with reference to the accompanying drawings in which.

DETAILED DESCRIPTION OF THE PREFERRED EMBODIMENTS

Figure 2B:
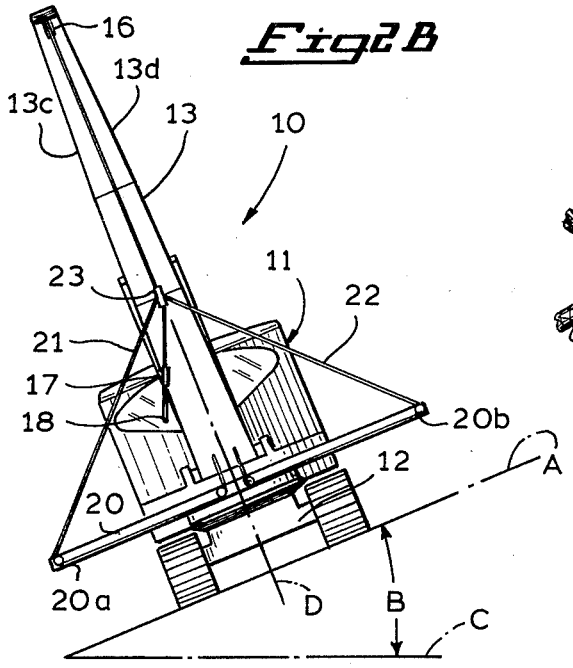
FIG. 2B is a view of the crane apparatus illustrated in FIG. 2A when the crane apparatus is tilted in a non-horizontal position.
Figure 2A:
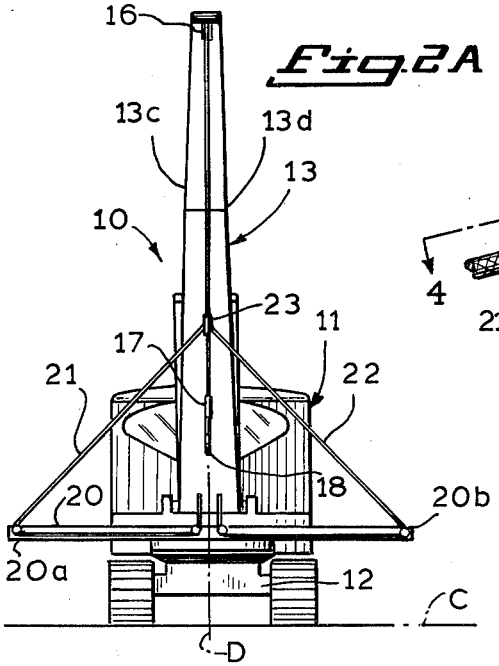
FIG. 2A is a front elevational view of the crane apparatus illustrated in FIG. 1.
Figure 1:
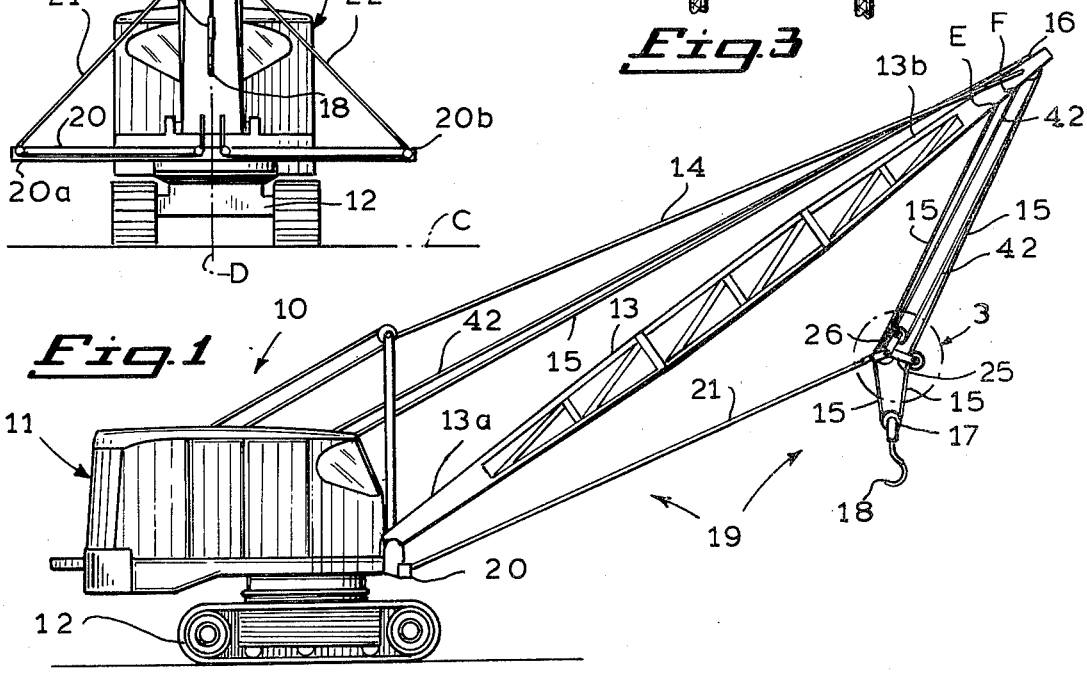
FIG. 1 is a side elevational view of the crane apparatus of the invention.

Referring to FIGS. 1 and 2A the crane apparatus of the invention is illustrated and is designated by a number 10. The crane apparatus 10 includes a conventional cab assembly 11, chassis and track assembly 12 and a boom assembly 13. The boom assembly 13 has the usual inner and outer end portions respectively designated as 13*a* and 13*b* plus sides 13*c* and 13*d*. Extending from cab assembly 11 is a conventional assembly including an elongated member or line 14 which is connected to the outer end of the boom assembly 13 for raising or lowering the outer end portion of the boom assembly 13 in a vertical direction in a conventional manner since the inner end portion of the boom assembly is rotatably connected to conventional structure located in the vicinity of/or within the cab assembly 11. Conventional apparatus is provided (not shown) within or near the cab assembly 11 for controlling a conventional cargo or load moving elongated member or line hoist 15. This apparatus may include conventional drum means (not shown) connected to the line 15 for pulling in or letting out this member 15. The member 15 also passes over rotatable pulley assembly 16 located near the outer end portion of the boom assembly 13 in a conventional manner to raise or lower cargo. The line 15 or boom hoist member also passes around the rotatable member 17 that is in turn connected to a load cargo engaging member 18 that has a hook shape. The apparatus 10 heretofor described represents apparatus well known in the art that is present on numerous cranes. The normal previously described crane apparatus functions in a manner that is well known in the art and hence the manner in which it functions will not be described in detail.

FIGS. 1, 2A and 2B also illustrate antipendulation means for preventing or reducing pendulation of cargo or load engaging apparatus or member 18 during crane apparatus 10 operations. This antipendulation means is designated generally by the number 19 and comprises an elongated or cross beam member 20 that is located with its long axis at substantially right angles to the long axis of the boom assembly 13 and is located in the vicinity of the inner end portion 13*a* of the boom assembly 13 and connected to or associated with the cab assembly 11. The respective beam member 20 end portions 20*a* and 20*b* are located away from the respective sides 13*c* and 13*d* of the boom assembly 13. Elongated members or lines 21 and 22 extend from the respective outer end portions 20*a* and 20*b* of the elongated member 20 to guide means 23 for engaging the cargo or load moving elongated member 15 for preventing or reducing the lateral movement of this member. It should be noted that the lines 21 and 22 can be pulled in or let out by conventional means including a conventional drum assembly (not shown) located in the cab assembly 11 to move the cargo or load block assembly means 23 laterally or to pull it in toward the cab assembly 11 or the like or to let it out in a direction away from the assembly 11 which results in the load means 23 being moved respectively toward or away from the inner end portion 13*a* of the boom assembly 13 that is located in the vicinity of the cab assembly 11 or the assembly 12. The block assembly 23 of the antipendulation means 19 also includes an elongated member or link means 26 for lifting the block assembly means 23 of the antipendulation means 19.

FIG. 2B shows how the antipendulation means 19 is utilized to prevent or reduce pendulation of the means 23 and the elongated member 15. As illustrated in FIG. 2B, the crane apparatus 10 rests in its normal position on a plane A that forms an angle B with the horizontal plane C or in other words the crane apparatus 10 of FIG. 2B rests in a non-horizontal plane whereas FIG. 2A illustrates the same apparatus 10 resting in a horizontal plane. The position illustrated in FIG. 2B is the same as that which is to be encountered with a crane located on watercraft in rough water where the crane apparatus 10 is subject to tipping or being moved about so that it is located in a non-horizontal orientation. In FIG. 2B it should be noted that the means 23 and at least a portion of the elongated member 15 lie substantially in a plane D that substantially intersects the elongated centerline of the boom assembly 13. This plane D is also oriented with respect to the boom assembly 13 so that it is substantially perpendicular to the horizontal plane C when the crane apparatus 10 is in the horizontal position as illustrated in FIG. 2A. Normally this would mean that the plane D would be substantially parallel to the sides 13*c* and 13*d* of the boom assembly 13 and substantially perpendicular to the long axis of the elongated member 20. This, of course, means that the plane D will not be substantially perpendicular to the horizontal plane C when the crane apparatus is tilted as illustrated in FIG. 2B.

This plane D is sometimes referred to as the topping or luffing plane of the elongated centerline of the boom assembly 13. The means 23 and at least a portion of the elongated member 15 are maintained in substantially the plane D even when the crane assembly is tipped in any direction, as illustrated in FIG. 2B, by pulling in substantially equally on the lines 21 and 22 so that rearward and sideward forces are exerted against the means 23 when the crane apparatus is in a non-horizontal position. As the crane apparatus 10 is in various non-horizontal positions the lines 21 and 22 will be pulled in or let out substantially equally to maintain the means 23 and at least a portion of the member 15 substantially in the plane D. This prevents or reduces pendulation of the member 23 and associated cargo or cargo handling apparatus. In addition, undesirable twisting or side loads on the boom assembly 13 are thus reduced or eliminated.

Figure 4:
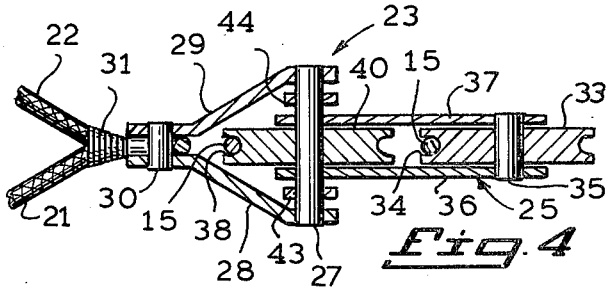
FIG. 4 is a sectional view of the structure illustrated in FIG. 3 taken substantially on the line 4—4 thereof.
Figure 3:
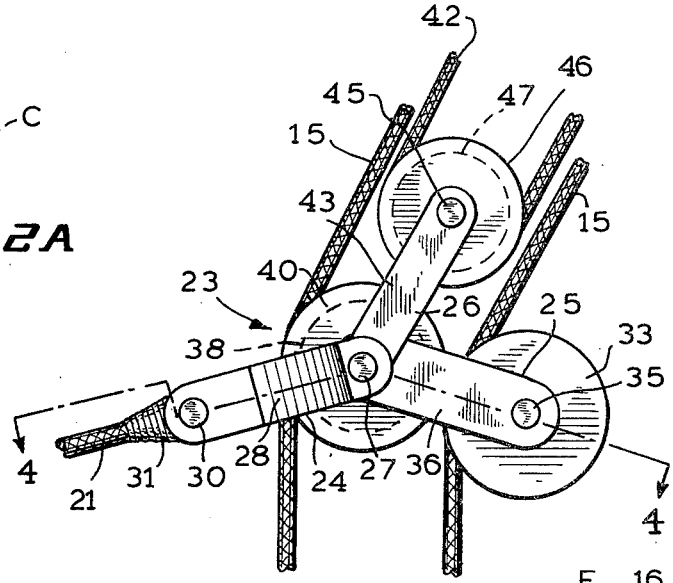
FIG. 3 is an enlarged portion of the crane apparatus invention illustrated in FIG. 1 taken within the circle 3 thereof.

The means 23 along with various associated lines is illustrated in the enlarged views in FIGS. 3 and 4. The block assembly means 23 comprises three interconnected link members 24, 25 and 26 which are all rotatably connected at one of their respective ends by an elongated pin member 27 about which the link members 24, 25 and 26 are free to rotate. The link member 24 has flat bent respective side members 28 and 29 with an interconnecting pin member 30 that passes through a flexible assembly 31 that is connected to the outer end portions of the lines 21 and 22. Also, a circular flat shaped pulley member 33 with a circumferential groove 34 that is adapted to receive a portion of the elongated member or line 15 is rotatably mounted on the elongated pin member 35 that has its outward ends connected to flat side members 36 and 37 of the link member 25.

Another portion of the elongated member or line 15 is located in the inner portion of a circumferential groove 38 located around the outer rim of a flat shaped pulley member 40 that is rotatably mounted on the pin member 27 whose outer ends are connected to the inner end portions of the side members 36 and 37 of the link member 25. As best illustrated in FIG. 1, the outer end of the line 15 is connected in a conventional manner to the outer end **13*b* of the boom assembly 13 at a point E. Link member 26 has the lower end portions of its flat side members 43 and 44 rotatably connected to the pin member 27. The other end portions of the flat side members 43 and 44 of the link member 26 are rotatably connected by the pin member 45 to the flat shaped pulley member 46. The pulley member 46 has a circumferential groove 47 in which the lower end portion of an elongated member or line 42 is located. The outer end portion of the line 42 has its outer end connected in a conventional manner to the outer end portion 13*b*** of the boom assembly at a point F.

It should be noted that the line 42 and the pulley 46 is used to move the assembly or means 23 in a generally upwardly or downwardly direction along the path of the hoist line 15. This is accomplished by pulling in on the inner end portion of the line 42 through conventional means such as a drum (not shown) that is located in or near the cab assembly 11. A portion of the line 42 passes around the rotatable assembly 16 in a conventional manner. As previously indicated, the lines 21 and 22 are generally used to move the means 23 in a generally inwardly or outwardly direction. In other words in a direction toward or away from the inner end portion **13*a* of the boom assembly 13 that is located near the cab assembly 11. If desired, inward and outward control of the means 23 can be accomplished simultaneously with upward and downward control of the means 23. Horizontal control of the control means 23 is usually accomplished as previously indicated by simultaneously pulling in on the lines 21 and 22 in a direction toward the cab assembly 11 or in a direction away from the outer end portion of the boom assembly 13. However, the horizontal control of the means 23 may if desired also be accomplished by pulling in on the line 21 and at the same time letting out on the line 22 or vice versa, or operating lines 21 and 22** independently.

Figure 5:
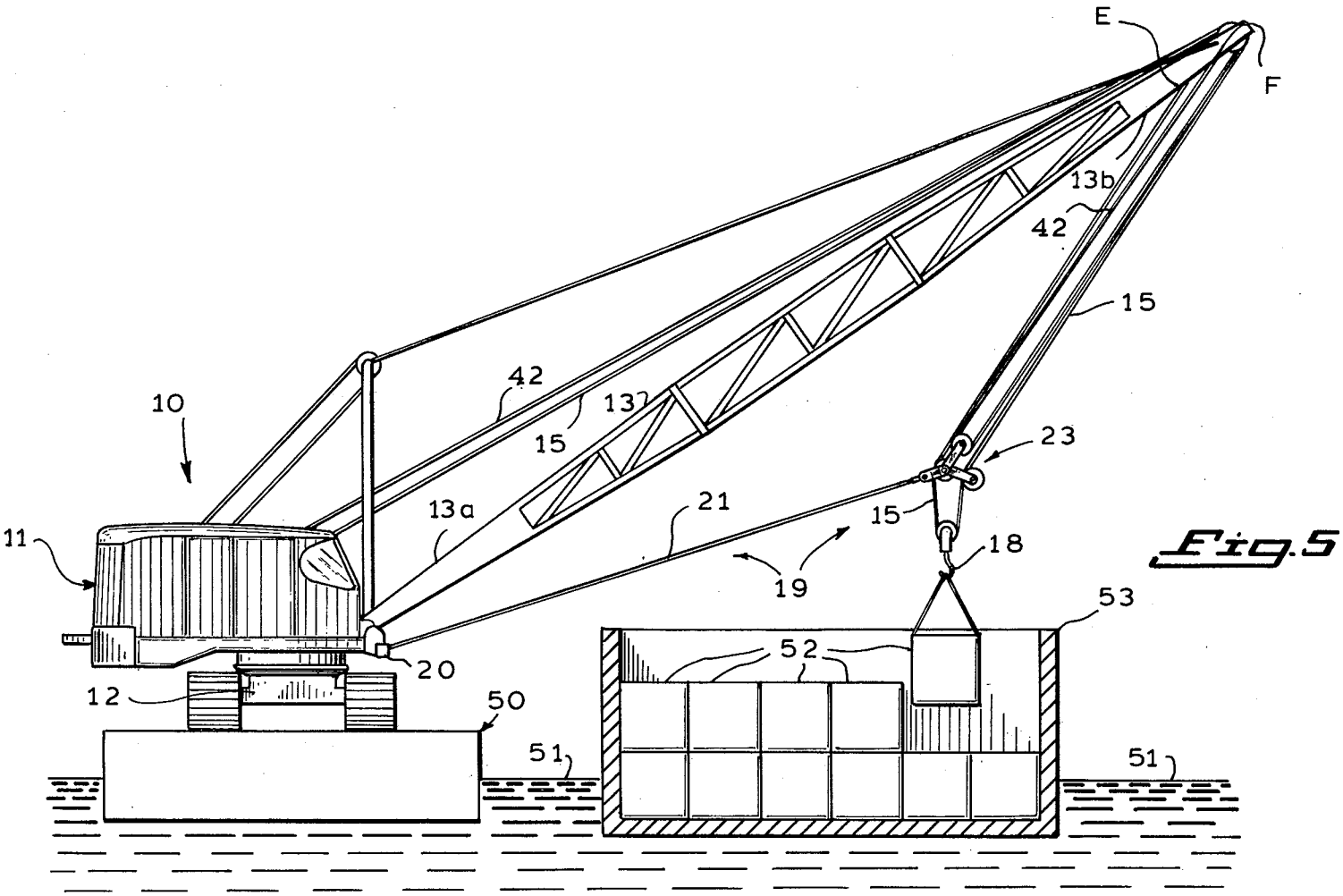
FIG. 5 is a side elevational view of the structure illustrated in FIGS. 1 through 4 illustrating its use in cargo loading or unloading operations involving the transfer of cargo from or to one floating vessel with the crane apparatus also located on a floating vessel.

FIG. 5 illustrates the crane apparatus previously described with respect to FIGS. 1 through 4 used in transferring cargo. As illustrated in FIG. 5, the crane apparatus 10 is located on a floating watercraft or platform 50 that is floating on the water 51 and is transferring cargo 52 in containers, pallets or other cargo handling devices to or from another floating watercraft such as a barge 53 that is also located in the water 51. With the crane apparatus 10 and in particular the means 23 and associated lines, it is possible to load the cargo 52 accurately even though there may be rough water 51 conditions that cause the watercrafts 50 and 53 to move upward and downward and/or tip with respect to each other.

Figure 6:
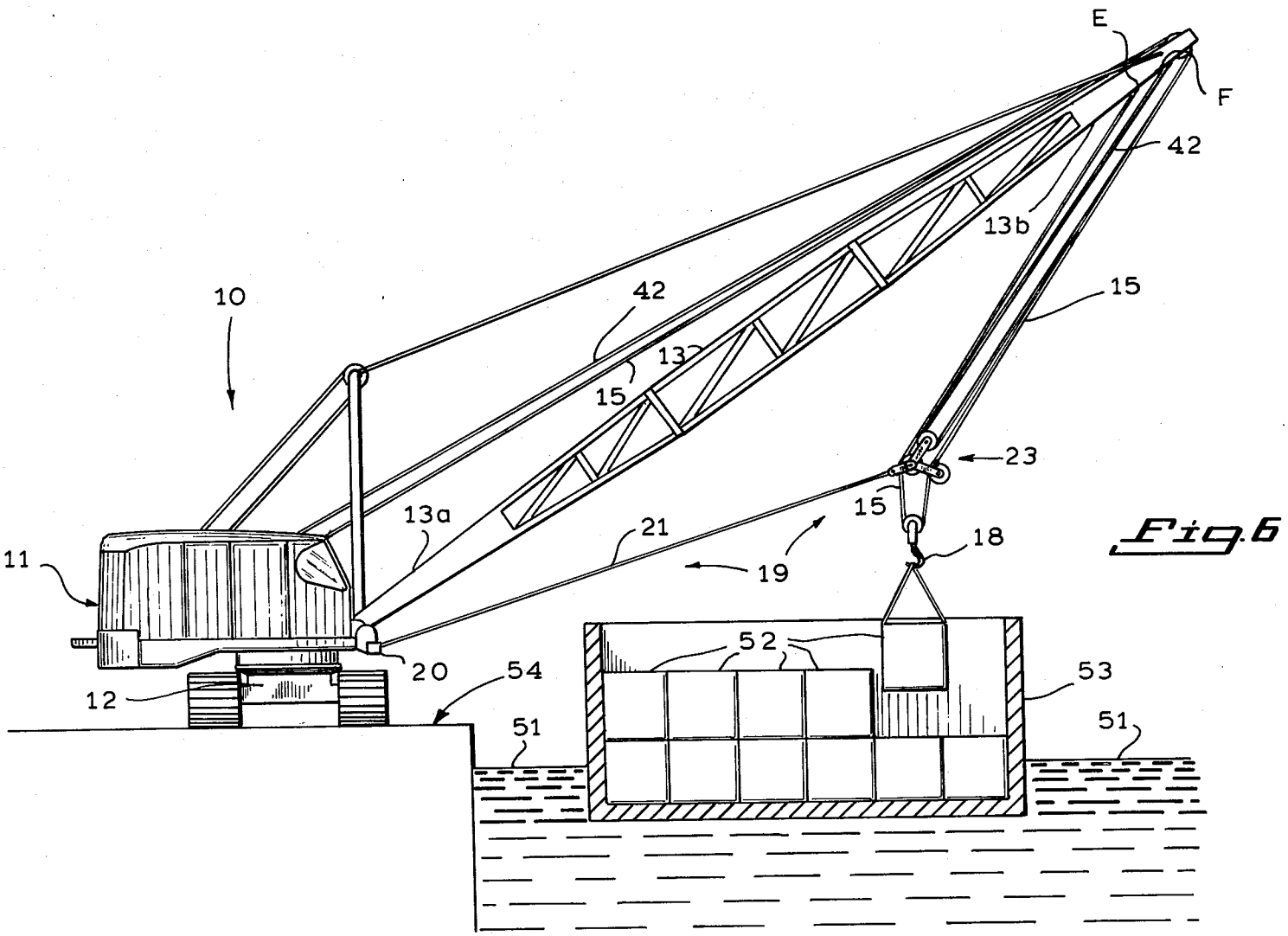
FIG. 6 is a side elevational view of the structure illustrated in FIGS. 1 through 4 illustrating its use in cargo loading operations involving the transfer of cargo from or to one floating vessel with the crane apparatus located on a non-floating structure.

In FIG. 6 the crane apparatus 10 is located on a non-floating structure such as a non-floating dock 54 that is not subject to movement as a result of the adjacently located water 51. However, the apparatus 10 located on the structure 54 is transferring cargo 52 to or from a watercraft 53 riding in the water 51. Even though the crane apparatus 10 is relatively non-movable, pendulation of the cargo 52 can still occur as a result of crane movements such as swinging of the cargo to a position above the watercraft 53 and then stopping or raising and lowering of the boom 13. Consequently, the antipendulation means 19 including the block assembly 23 and its associated lines or elongated members permit loading of the cargo 52 or unloading of the cargo 52 without damage to the cargo 52, the apparatus 10 or the vessel or craft 53 in the previously indicated manner.

Thus far the antipendulation means or apparatus 19 has been described as an integral part of the crane apparatus 10. However, it should be appreciated that the means or apparatus 19 can be supplied separately to be used to retrofit or convert existing cranes to give the cranes an antipendulation capability to reduce or prevent pendulation of the cargo or cargo transferring apparatus.

Figure 7:
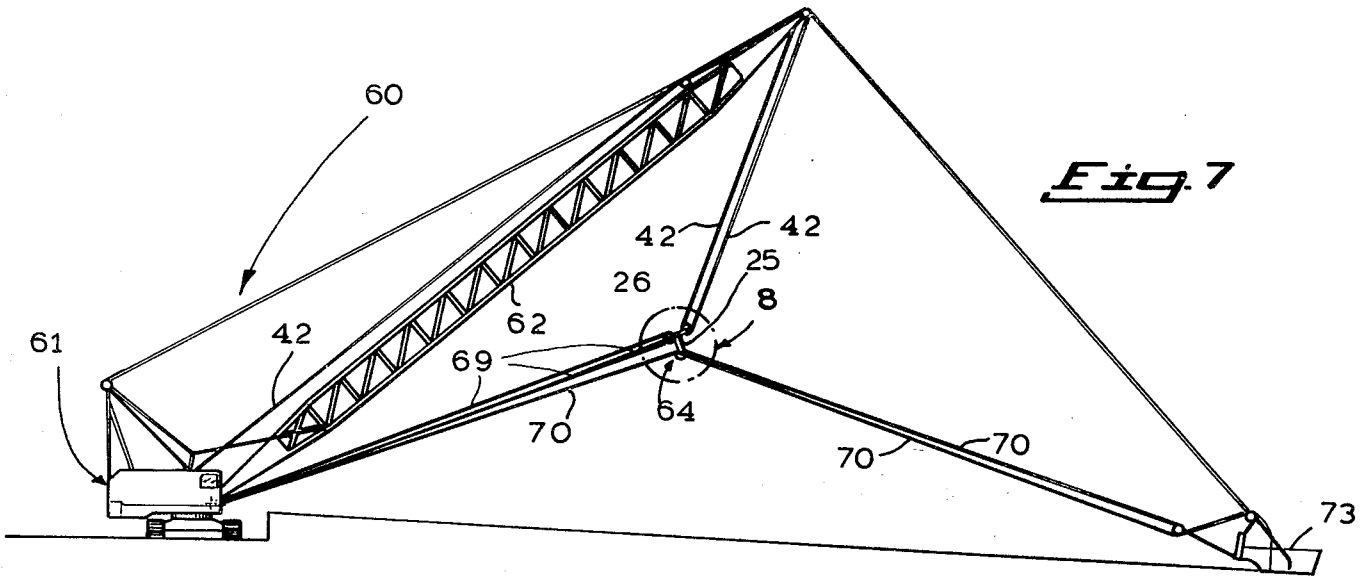
FIG. 7 is a side elevational view of another crane.
Figure 8:
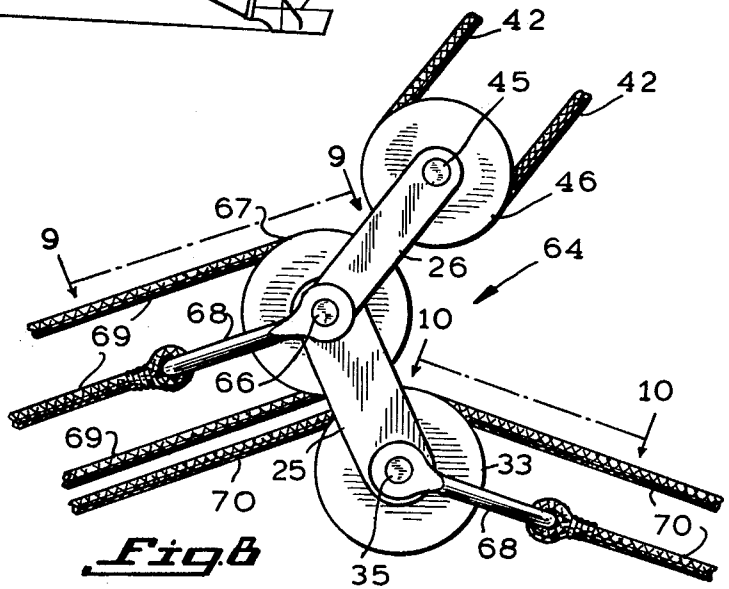
FIG. 8 is an enlarged view of a portion of the crane illustrated in FIG. 7 taken with the circle 8 thereof.
Figure 10:
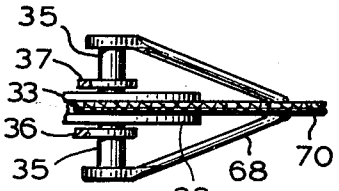
FIG. 10 is a view taken substantially in the direction of the line 10—10 in FIG. 8.

FIGS. 7, 8 and 10 illustrate a modification to the crane apparatus 10 which is designated generally by the number 60. The crane apparatus 60 has a conventional cab assembly 61, associated boom member 62 and other conventional elements or parts associated with the previously described crane apparatus 10. However, it should be noted that the means 19 associated with the crane apparatus 10 has been replaced by a control means block assembly designated generally by the number 64. This means 64 for controlling the load has portions that are similar to the previously described link means or member 26. It should also be noted that the apparatus illustrated in FIGS. 7 through 10 does not provide for any elongated cross beam member 20 and associated lines 21 and 22 such as that illustrated in FIGS. 1 and 2 in certain other FIGS. Consequently, sidewise control of the block assembly 64 has to a large extent been eliminated. However, such control is not essential for some operations such as the dragline operation illustrated in FIG. 7.

Figure 9:
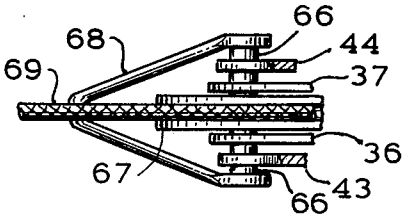
FIG. 9 is a view taken substantially in the direction of the line 9—9 in FIG. 8.

As indicated in FIG. 8, the means 64 has portions of the previously described block assembly 23. In particular the means 64 has the previously described link member 26, the associated pulley member 46 and the associated pin member 45 about which the pulley member 46 rotates. The pulley member 46 also engages the previously described line 42. Likewise the means 64 has the link member 25, the associated pulley member 33 and associated pin member 35 about which the pulley member 33 rotates. However, the ends of the members 36 and 37 of the link member 25 have an aperture that receives a pin member 66 and pulley member 67 that rotates about the pin member 66 as best illustrated in FIG. 9. The outer end portions of the pin member 66 rotatably receive the ends of a substantially V-shaped connecting member 68 as best illustrated in FIG. 9.

As illustrated in FIGS. 8 and 9, one end portion of the elongated member, line or cable 69, is connected to the inner end portion of the V-shaped connecting member 68 that is located closest to the cab assembly 61 and member 69 extends away from the means 64 toward the cab assembly 61 where it is received in a conventional manner around conventional pulleys and/or drums (not shown) well known to those skilled in the art. As illustrated in FIGS. 8 and 9, the same member 69 has at various times portions thereof that extend from or toward the cab assembly 61 or its vicinity and around pulley member 67 in order to pull the means 64 toward the cab assembly 61 or to let it out away from the cab assembly 61 or the inner end of the boom assembly 62 in a conventional manner well known in the art.

As illustrated in FIGS. 7, 8 and 10 another elongated member or line 70 is connected in a conventional manner in the cab assembly 61 or the vicinity thereof. As best illustrated in FIG. 10, a pulley member 33 is rotatably mounted around the pin member 35 whose outer end portions rotatably receive aperatures in another V-shaped member 68 that is rotatably mounted about the outer end portions of the pin member 35. The outer end of the line 70 is connected to the V-shaped member and other portions of the line 70 are located about the pulley member 33 and other portions of the line 70 located furthermost from the cab assembly 61 are woven about a suitable assembly (not shown) that forms part of a conventional drag line bucket 73 (FIG. 7) or similar scooping means that is designed to scoop materials and move them in a different direction, which is normally toward the cab assembly 61.

The control means 64 has been discussed previously as if it was part of the original crane apparatus 60. However, the control means 64 can be supplied separately and used to retrofit existing crane apparatus.

Figures 11, 12, 13:
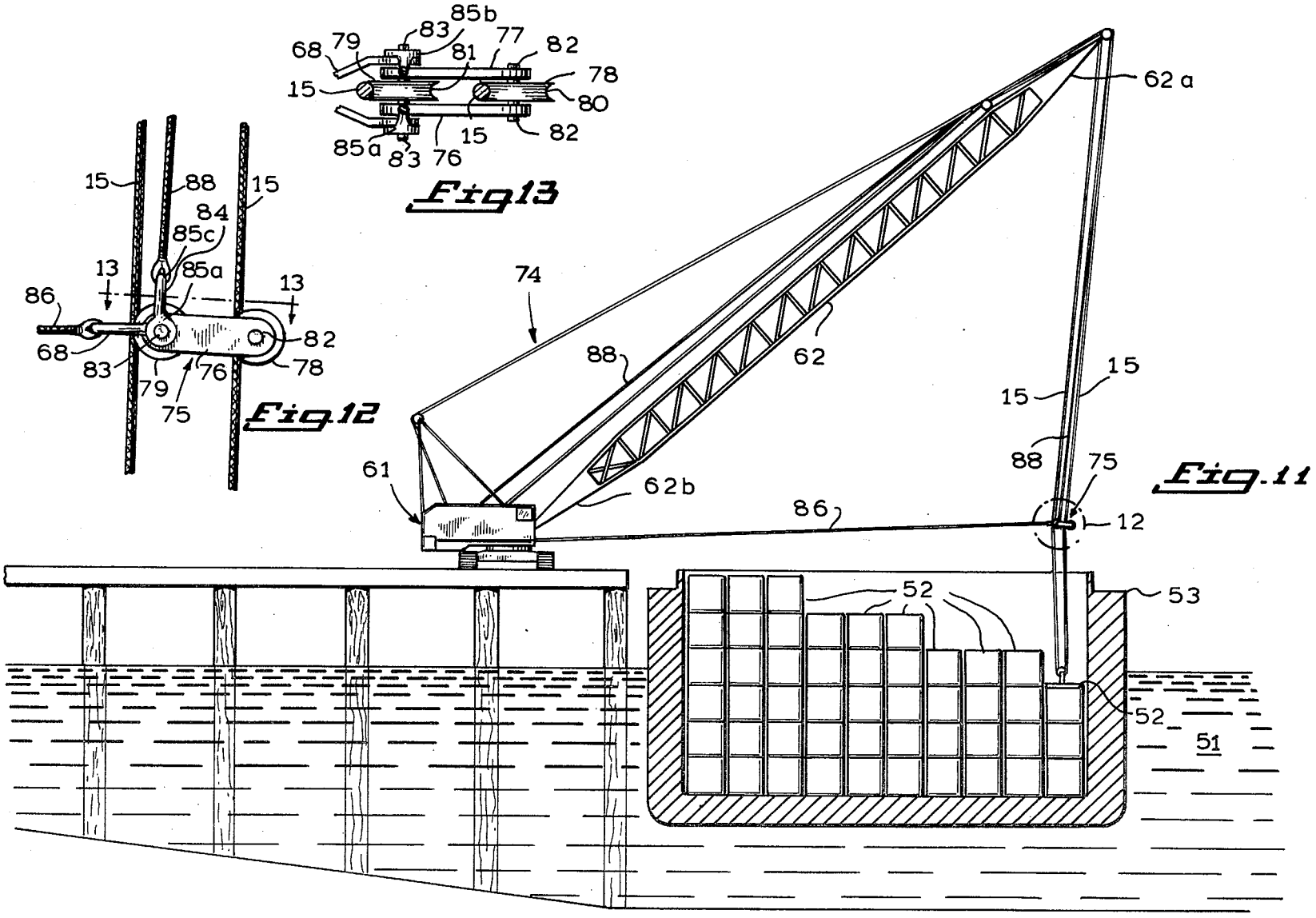
FIG. 11 is a side elevational view of another crane.
FIG. 12 is an enlarged portion of the crane illustrated in FIG. 11 taken within the circle 12 thereof.
FIG. 13 is a sectional view of the structure illustrated in FIG. 12 taken substantially on the line 13—13 thereof.

FIGS. 11 through 13 illustrate an additional embodiment of the invention that is designated generally by the number 74. The embodiment of the invention 74 has the same cab 61, boom assembly 62 and related parts as illustrated in FIG. 7 and related FIGS. 8 through 10. The embodiment of the invention illustrated in FIGS. 11 through 13 also has an elongated member or line 15 such as that illustrated in FIGS. 1, 2 and 3 which is used for moving cargo 52. However, in this instance the member 15 is reaved through a block assembly 75 that is different from block assembly 23 that is best illustrated in FIGS. 3 and 4. The embodiment of the invention illustrated in FIGS. 11 through 13 also has an elongated member or line 88 that is similar to and performs in a similar manner to the line 42 illustrated in FIGS. 1, 2 and 3. FIGS. 12 and 13 illustrate the block assembly 75 in greater detail. As illustrated in FIGS. 12 and 13, the block assembly 75 comprises flat parallel plates with rounded ends designated by the numbers 76 and 77 respectively. Flat shaped pulley members are designated by the respective numbers 78 and 79 and are located at the respective ends of the members 76 and 77. Each of these pulley members 78 and 79 have a circumferential groove in their outer periphery which is designated by the respective number 80 and 81 as is best illustrated in FIG. 13 that are shaped to receive the line 15. These pulley members 78 and 79 are rotatably mounted about their respective pins 82 and 83 that extend through the ends of the plate members 76 and 77.

As best illustrated in FIG. 13, the pin member 83 has ends which extend considerably farther outward from the outer surface of the members 76 and 77 than the pin member 82. The inner outer end portions of the pin member 83 are rotatably connected to a connecting member 68 that is identical to the member 68 which is best illustrated in FIG. 9. A V-shaped hoist member 84 has its lower portions **85*a* and 85*b* rotatably connected to the respective outer ends of the pin member 83 for hoisting the entire block member in substantially a vertical direction. This member 84 has its upper end portion 85*c* connected to an elongated line or cable member 88 that extends from the outer end portion 62*a* of the boom member 62. Another elongated member or cable is connected to the block assembly 75. This cable member is designated by the number 86 and has one end connected to the inner end portion of the V-shaped member 68. The other end of the cable 86 is connected to drums or other apparatus (not shown) known in the art located in the vicinity of the cab assembly 61. As known in the art, the members 86 and 88 can comprise a single or a plurality of elongated members. The member or members designated by the number 86 permit the inward or outward movement of the block member 75 with respect to the cab assembly 61 or the inner end portion 62*b* of the boom member 62 so that cargo can be loaded in an orderly fashion without the need to raise or lower the boom member 62**.

The crane apparatus 74 has been described as if it originally included the block assembly 75 and related apparatus. However, the assembly 75 and related apparatus can be supplied to retrofit existing crane apparatus.

Figure 14:
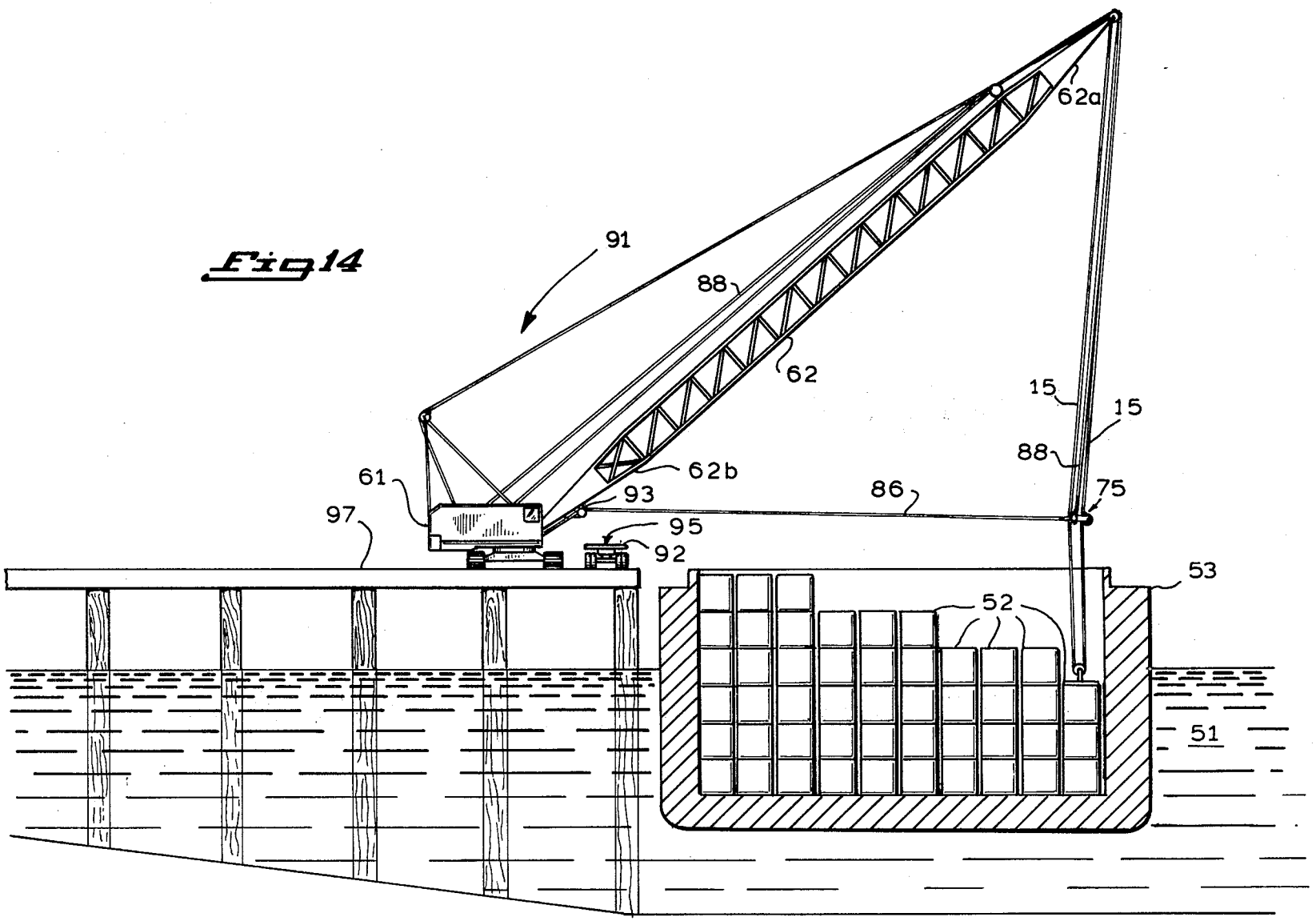
FIG. 14 is a side elevational view of an alternative modification of the embodiment of the illustrated in FIGS. 11, 12 and 13.

FIG. 14 illustrates an additional embodiment of the crane invention designated generally by the number 91 located on a dock 97 such as that also illustrated in FIG. 11. The embodiment of the invention 91 contains all of the components of the embodiment illustrated in FIGS. 11 through 13 such as the same cab assembly 61, associated boom member 62, line 15, the block assembly 75 and the line or lines designated by the number 86 that interconnect the block assembly 75 and appropriate machinery known in the art located near or in the cab assembly 61. However, the primary important difference between the embodiment illustrated in FIGS. 11 through 13 and the embodiment of FIG. 14 is the provision for means for raising the lines or line designated by the number 86 above the normal level that the lines or line 86 would naturally take.

As illustrated in FIG. 14, means for elevating line or lines 86 comprising a pulley assembly 93 is attached to the lower portion of the boom member 62. This pulley assembly 93 can be located almost anywhere between the outer end and the inner end portions **62*a* and 62*b* of the boom member 62. However, in the preferred embodiment it is located toward the inner end portion 62*b* of the boom member 62. It is important that the pulley assembly 93 be located at such an elevation above the upper portion or surface 92 of the transporting member designated by the number 95 for receiving or unloading cargo 52 to make certain that there is sufficient clearance between the surface 92 and the member or members 86 to permit the passage of cargo 52 to or from the surface 92 without any interference with the member or members 86. Consequently, the location of the pulley assembly 93 will depend to a great extent upon the elevation of the surface 92 and the height of the cargo 52. Of course, other factors such as pendulation or possible pendulation of the cargo 52 will have to be taken into account in selecting the optimum location of the pulley assembly 93. It can also be appreciated that the pulley assembly 93 need not be located on or near the underside of the boom member 62. In this connection it should be realized that it could be located on top of the boom member 62 between its inner and outer portions or possibly on top of or near the cab assembly 61. It can also be appreciated that the pulley 93** position can be adjustable using links, tracks and cylinders (not shown) known in the art. Of course, the elevating means can be supplied separately to retrofit existing cranes in order to provide the cranes with additional capabilities.

The crane apparatus of the invention and the method of use thereof are carried out in the following manner. Cargo transfer operations are carried out through the use of apparatus illustrated in FIGS. 1 through 4 which is designated generally by the number 10. In general, the apparatus 10 is conventional in nature. However, the antipendulation means 19 is associated with embodiment 10. Through the use of the antipendulation means 19, pendulation or lateral movement in any direction of the cargo or load or the load or cargo engaging member 18 is reduced or prevented since the load or cargo is not permitted to deviate in a substantial manner from the central topping or luffing plane extending substantially through the central axis of the boom member or assembly 13 so that the load means 23 of the antipendulation means 19 lies substantially in the topping or luffing plane of the centerline of the boom assembly 13. This antipendulation means 19 reduces or substantially eliminates excessive side loading of the boom member or assembly 13 which could be dangerous and result in structural failure of the boom assembly 13 or portions thereof.

As illustrated in FIG. 5, the embodiment of the invention 10 set forth in FIGS. 1 through 4 is shown in use transferring cargo designated by the number 52 between one moving vessel designated by the number 53 which floats in the water 51 to another vessel 50 that also floats in the water 51. Since both of the water crafts 50 and 53 are located in the water 51 there can be rough water due to weather conditions, etc., and transportation of the cargo 52 to or from the vessel 53 can be difficult without the antipendulation means of this invention. However, through the use of the antipendulation means previously discussed and designated by the number 19, even though the water craft 53 may be moving in an upward or downward direction or even tipping with respect to the water craft 50 or vice versa the antipendulation means permits accurate placement of the cargo 52 on to the vessel 53 or transfer of cargo 52 between the water craft 50 and 53 without damage to the cargo or to the water craft 50 or 53.

As indicated previously with respect to the discussion in connection with FIGS. 1 through 4, the antipendulation means 19 even under severe conditions with transfer occurring, as illustrated in FIG. 5, can insure that the load means 23 of the antipendulation means 19 lies substantially in the topping or luffing plane of the centerline of the boom assembly 13 by the pulling in or letting out of the members 21 through conventional means known in the art which are located in or near the cab assembly 11. In this connection, it should be noted that FIG. 2B only illustrates an example of the type of tipping or non-horizontal positions of the crane apparatus 10 that can result from rough water conditions and the like. The tipping, etc. that results in the non-horizontal positioning of the crane apparatus can occur in any direction even though only one direction is illustrated as an example in FIG. 2B.

Consequently, when the vessel 50 or 53 moves with respect to the other vessel the operator that controls the members 21 can make the appropriate adjustments through the elongated members 21 to pull inward or let out on the load means 23 of the antipendulation means 19 to compensate for such movement. It will of course be realized that under some conditions, which are well known in the art, that the boom member itself, etc., may have to be raised or lowered under such severe conditions as well as utilizing the antipendulation means 19. However, without the antipendulation means 19 cargo transfer between the vessels 50 and 53 would be impossible under many conditions. The transfer operation itself is of course carried out by transferring cargo 52 to or from the upper portion of the vessel 50 to or from the hold or cargo holding means of the vessel 53 primarily through use of the antipendulation means 19 under adverse sea or water conditions.

The invention illustrated in FIG. 6 designated by the number 10 is used in a manner which is the same as that set forth with respect to the invention 10 illustrated in FIG. 5 except that the crane apparatus 10 is located on a stationary object such as the non-floating dock 54 rather than a watercraft such as that designated by the number 50 that is floating in the water 51 in FIG. 5. Consequently, the transfer of cargo or cargo containers 52 is accomplished to or from a stationary object and a floating or non-stationary object. Under these conditions, pendulation can be induced by normal crane operation motions such as swinging of the cab or raising or lowering the boom. Except for this difference, the operation of the apparatus illustrated in FIG. 6 is the same as that with respect to FIG. 5.

The embodiment of the invention designated generally by the number 60 which is illustrated in FIGS. 7, 8, 9 and 10 lacks the antipendulation means of the embodiment designated by the number 10. In this connection it should be noted that the antipendulation means 19 of the embodiment 10 has been replaced by the control means block assembly 64 that permits the crane apparatus to be used to pull materials primarily in a direction that is located toward the inner end portion of the boom member 62 of crane apparatus 60. The embodiment designated generally by the number 60 is particularly suited for dragline type of operations and in performing such operations the outer end portion of the elongated member is connected to the drag line bucket 73. After the drag line bucket 73 has been pulled inward toward the inner end portion of the boom member 62, the elongated member 70 can be let out through means known in the art to allow the drag line bucket 73 to move in a direction away from the inner end portion of the boom member 62.

The crane apparatus designated generally by the number 74 that is illustrated in FIGS. 11, 12 and 13 has the different block assembly 75 and since it does not have antipendulation means the crane apparatus 74 should only be used under conditions where severe pendulation is unlikely to occur. In using the crane assembly 74 the load 52 is controlled in a horizontal direction by by pulling or letting out on the line 86 to cause the block assembly 75 to be respectively pulled toward the inner end portion 26 of the boom assembly 62 or let out in the opposite direction. Vertical control of the load 52 is accomplished through the use of the line 15 that is reaved through the block assembly 75. By pulling in on the line 15 through suitable means (not shown) that are known in the art the amount of the line 15 that is let out or unreeled is reduced. This causes pulling of the line 15 located between the cargo 52 and the block assembly 75 and this in turn causes the cargo 15 to rise in a generally upward direction. Conversely, letting out or unreeling the line 15 causes the amount of the line 15 located between the block assembly 75 and the load 52 to increase the amount of the line 15 causing the load 52 to move in a generally downward direction. In actual cargo loading and unloading operations the lines 86 and 15 are both pulled in and let out in order to transfer the cargo 52 to or from a vessel or from one location to another. In addition, the line 88 can be pulled in and let out in order to vary the vertical position of the block assembly 75 with respect to the outer end boom portion 62.

The embodiment of the invention set forth in FIG. 14 and designated generally by the number 91 is utilized in substantially the same manner as the crane apparatus 74 illustrated in FIGS. 11 through 13. However in using the crane assembly 91, the line 86 is caused to be elevated in a direction toward the boom assembly 62 through the use of the member 93. This permits a vehicle or any other cargo 52 carrying member 92 to be moved under the boom member 62. As a consequence, the loading or unloading of cargo, particularly large size cargo, is made easier.

If it is deemed desirable to retrofit or give an existing crane the ability to control pendulation of cargo during cargo transferring operations, then the antipendulation means 19 is provided and appropriately connected or associated with the crane that is to be retrofitted. This means that the beam member 20 is connected to the crane in the vicinity of the inner end portion 13*a* of the boom assembly 13 so that the long axis is substantially perpendicular to the long axis of the boom assembly 13 as illustrated in FIGS. 1, 2A and 2B. The block assembly means 23 and associated lines or elongated members 21, 22 and 42 are also connected to the crane.

As illustrated in FIGS. 1 through 4, this is accomplished by attaching one end of the line 42 to the outer end portion 13*b* of the boom assembly 13. The line 42 is also wound around the outer circumference of the pulley 46 and around the outer end portion 13*b* of the boom assembly 13. The line 42 is then pulled toward the inner end portion 13*a* of the boom assembly 13 and connected to suitable machinery such as a drum known in the art for winding in or letting out the line 42. The portions of the lines or elongated members 21 and 22 that are not attached to the block assembly means 23 are connected in a conventional manner to the respective end portions 20*a* and 20*b* of the boom assembly and from there the end portions of the elongated members 21 and 22 are connected to suitable machinery known in the art that may be located in the cab assembly 11 for winding in or letting out the lines 21 and 22. When the antipendulation means 19 is connected to the crane, it is then utilized in the previously described manner.

In a similar manner the block assembly 64 and associated lines or elongated members illustrated in FIGS. 7 through 10 and the block assembly 75 and associated lines or elongated members illustrated in FIGS. 11 through 14 may be connected to existing cranes. However, the lines or elongated members 69 and 86 are not connected to any elongated member 20 but rather to conventional apparatus such as a drum located near the inner end of the respective boom members. This drum can be located within the cab assembly 61.

The block assembly 64 illustrated in FIGS. 7 through 10 is connected to the crane that is to be retrofitted, such as that illustrated in FIG. 7, by connecting one end of the elongated member or line 42 to the outer end portion 62*a* of the boom assembly 62. The line 42 is then passed around the pulley member 46 and then around the outer end portion 62*a* of the boom assembly 62. The inner end portion of the line 42 is then pulled toward the inner end portion 62*b* of the boom assembly 62 and connected to conventional drum means (not shown), for pulling in or letting out on the line 42 located in the vicinity of or in the cab assembly. The inner end portion of the elongated member or line 69, whose outer end portion is connected to the block assembly 64, is also connected to conventional apparatus such as drum means (not shown) for pulling in or letting out on the line 69. The elongated member or line 70, that has one end connected to the block assembly 64, is reaved through conventional apparatus (not shown) that forms part of the conventional drag line bucket 73 and then this line is located around a portion of the pulley member 33 and fed to conventional drum or similar apparatus (not shown) located in or near the cab assembly 61 and near the inner portion 62*b* of the boom assembly 62. After the block assembly 64 and associated lines or elongated members are connected to the crane, the crane can function in the manner previously described in connection with the crane apparatus 60 illustrated in FIGS. 7 through 10.

The block assembly 75 illustrated in FIGS. 11 through 13 is connected to the crane that is to be retrofitted, such as that illustrated in FIG. 11, by passing the elongated member or line 88 over the outer end portion 62*a* of the boom assembly 62. The end portion of the line 88 that is not connected to the block assembly 75 is connected to suitable conventional drum means or the like (not shown) located near the inner boom portion 62*b* for pulling in on or letting out the line 88. The line or elongated member 15 is reaved through the block assembly 75 in the manner illustrated in FIGS. 12 and 13 and the end portion of the elongated member or line 86 that is not connected to the block assembly 75 is connected to suitable conventional apparatus (not shown) for pulling in or letting out on the line 86. After the block assembly 75 and associated lines or elongated members are connected to the crane, the crane can function in the manner previously described in connection with the crane apparatus 74 illustrated in FIGS. 11 through 13.

If desired the pulley member 92 or means for elevating an elongated member can also be added to an existing crane that has an elongated member or line 86 such as that illustrated in FIGS. 11 and 14. In adding the member 93 to the crane it is connected to the crane's boom assembly 62 at a suitable location that is usually located near the inner boom portion 62*b*. The elongated member or line 86 is then passed over the member 93 to cause the crane to function in the manner previously described in connection with the crane apparatus 91 illustrated in FIG. 14.

It will be understood by those skilled in the art that the crane apparatus illustrated in the drawings only represents some of the many types of crane apparatus that can benefit from this invention and apparatus that can be retrofitted with the invention. In addition many of the details associated with conventional cranes and their normal operation have not been discussed since they are well known to those skilled in the art.

Although the invention has been described in considerable detail with reference to certain preferred embodiments, it will be understood that variations and modifications may be made within the spirit and scope of the invention as defined in the appended claims.

What is claimed is:

1. Crane apparatus comprising: a boom assembly having inner and outer end portions and a topping or luffing plane; a hoist line extending from the outer end portion of said boom assembly; antipendulation means for maintaining at least a portion of said hoist line substantially within the topping or luffing plane of said boom assembly when said crane apparatus is tipped in a non-horizontal position and when said crane apparatus is in a horizontal position, said antipendulation means comprising guide means with a path of movement along said hoist line for guiding said hoist line and means associated with said guide means for exerting sideward forces against said guide means for maintaining said guide means substantially within the topping or luffing plane of said boom assembly, said sideward force exerting means comprising laterally extending rigid means located in the vicinity of the inner end portion of said boom assembly for extending lines, said laterally extending rigid means having respective portions located away from the respective sides of said boom assembly, and lines extending from the respective portions of said laterally extending rigid means toward said guide means, means associated with said lines extending toward said guide means for letting out or drawing in either simultaneously or individually on said lines extending toward said guide means and means associated with said guide means for moving said guide means in a generally upwardly or downwardly or vertical direction along the path of said hoist line.

2. The crane apparatus of claim 1 wherein the portions located away from the respective sides of said boom assembly comprise the respective outer end portions of said laterally extending rigid means.

3. The crane apparatus of claim 2 wherein said laterally extending rigid means has an elongated axis.

4. The crane apparatus of claim 3 wherein said boom assembly has a long axis and the elongated axis of said laterally extending rigid means is located substantially at right angles to the long axis of said boom assembly.

5. The crane apparatus of claim 1 wherein said guide means comprises at least one rotatable member in contact with said hoist line.

6. The crane apparatus of claim 1 wherein said means for moving said guide means in a generally upwardly or downwardly or vertical direction comprises an elongated member operatively associated with said guide means.

7. The crane apparatus of claim 6 wherein said means for moving said guide means in a generally upwardly or downwardly or vertical direction further comprises a rotatable member in rotatable contact with the elongated member of said means for vertically moving said guide means.

8. The crane apparatus of claim 7 wherein said guide means comprises at least two interconnected rotatable members in contact with said hoist line.

9. The crane apparatus of claim 8 further comprising means for interconnecting said interconnected rotatable members in contact with said elongated hoist line and said rotatable member in contact with the elongated member of said means for vertically moving said guide means.

10. The crane apparatus of claim 9 wherein said interconnecting means comprises interconnected link members.

11. The crane apparatus of claim 10 wherein said interconnected link members are rotatably connected.

12. The crane apparatus of claim 11 further comprising a link member associated with said lines extending from the respective portions of said laterally extending rigid means, said link member associated with said lines being rotatably connected to said interconnected link members.

13. The crane apparatus of claim 12 wherein said rotatably connected link members are interconnected at one of their respective ends.

* * * * *